United States Patent [19]

Englert

[11] 4,312,196

[45] Jan. 26, 1982

[54] GUIDEBAR SHOGGING GUIDE APPARATUS FOR WARP KNITTING MACHINES

[75] Inventor: Norbert Englert, Schaafheim, Fed. Rep. of Germany

[73] Assignee: Karl Mayer Textilmaschinenfabrik GmbH, Obertshausen, Fed. Rep. of Germany

[21] Appl. No.: 165,040

[22] Filed: Jul. 1, 1980

[30] Foreign Application Priority Data

Jul. 4, 1979 [DE] Fed. Rep. of Germany ..... 2926928

[51] Int. Cl.[3] ..... D04B 23/00

[52] U.S. Cl. ..... 66/207

[58] Field of Search ..... 66/203, 207, 204, 205

[56] References Cited

U.S. PATENT DOCUMENTS 3,478,543 11/1969 Faninger ..... 66/205
3,653,232 4/1972 Walter ..... 66/205

FOREIGN PATENT DOCUMENTS 90683 2/1897 Fed. Rep. of Germany ..... 66/207
204446 11/1908 Fed. Rep. of Germany ..... 66/207
210865 6/1909 Fed. Rep. of Germany ..... 66/207
265540 10/1913 Fed. Rep. of Germany ..... 66/207
489059 1/1930 Fed. Rep. of Germany ..... 66/207

*Primary Examiner*—Ronald Feldbaum
*Attorney, Agent, or Firm*—Omri M. Behr

[57] ABSTRACT

A guidebar shogging guide apparatus for use on warp knitting machines includes a guide assembly operatively coupled to the guidebar via an elongated slider bar means. The guide assembly includes a plurality of setting elements disposed within a housing. The setting elements are moved into position by means of a jacquard mechanism and provide predetermined increments which determine the position of the slider bar. These incremental distances are proportional to the needle spacing of the warp knitting machine needle bar. A shogging lever operatively coupled between the slider bar and the guidebar converts the incremental distances provided by the setting elements into an exact number of needle spaces thereby permitting the guidebar to be shogged in accordance with a predetermined program which controls the jacquard mechanism.

7 Claims, 4 Drawing Figures

GUIDEBAR SHOGGING GUIDE APPARATUS FOR WARP KNITTING MACHINES

BACKGROUND OF THE INVENTION

1. Field of the Invention

The present invention relates to a guidebar shogging guide apparatus for warp knitting machines and in particular to a guide apparatus that is adjustable and automatically programmable in fixed increments that are proportional to the knitting machine needle spacing.

2. Discussion of the Relevant Art

Shogging mechanisms of different types are available in the art and are disclosed in a textbook entitled, "Warp Knitting Technology" by D. F. Paling first published in 1952 and reprinted in 1970 by the Columbine Press (Publishers Limited). Another shogging or steering element is disclosed in "Die Kettenwirk Maschine" by Emil Michael, published by Konradinverlagrobert Kohlhammer of Stuttgart, West Germany. Pages 37 through 40 disclose a guide mechanism to control the movement of a warp knitting machine guidebar which contain seven setting elements (see FIG. 55 at page 39) to obtain the incremental distances that the guidebar is to be moved. The movable setting elements are placed into position by means of a conventional jacquard arrangement. The jacquard arrangement moves the setting element into a predetermined position so that the head portion of the setting element provides a defined thickness along a longitudinal axis. By choosing a combination of different setting elements, having different thicknesses, the longitudinal thickness which determines the position of the slider bar that is operably coupled to the guidebar may be modified in accordance with the preset program. In the embodiment disclosed, the first setting element always remains in position and is provided with a stepped portion. The stepped portion is equivalent to one unit of displacement with a spacing between the needles on the needle bar. In its thinner portion, it is made to correspond to the known setting of the slider which is coupled to the guidebar. The other setting elements are brought into the path of the slider when they are activated by the jacquard mechanism and thus provide the additional longitudinal thickness and longitudinal displacement for the slider bar. The second setting element is provided with a thickness equal to two units and the third and remaining elements are each provided with a thickness in the longitudinal direction equivalent to four units of displacement. The step provided by the thickness of four units of displacement is sufficiently large so that during the activation of the third setting element the second setting element is completely enfolded when it is not activated. When a warp knitting machine is provided with a large needle separation on the needle bar then the size of each unit of displacement is thick enough so that the thickness of the setting elements are sufficiently thick in the longitudinal direction to be rugged and have a long life. If the needle spacing or separation therebetween on the needle bar is to be very small then it is necessary to utilize very thin setting elements which have the disadvantage of minimal strength during the strain placed upon it when the machine is operated. The necessity for maintaining the setting elements to their prescribed thicknesses is obvious, since the movement of the guidebar must be sufficient to clear a prescribed number of needles to perform with the design program. If the thickness of the setting elements change with time, since they may wear, the shogging of the guidebar may not be sufficient to clear the required needle thereby causing defects in the material manufactured. With the devices known, every time the needle spacing is varied, the thickness of the setting elements must be changed to correspond thereto in order to provide the proper increments of deflection for the guidebar.

The present invention overcomes the shortcomings found in the prior art by providing a guide apparatus similar in function to the above-described type wherein the setting elements are always of a sufficient thickness and stability to be reliable and have minimal wear. This is accomplished by providing setting elements which are thicker than the known units and instead of providing a raised portion to obtain the incremental displacement units a stepped down or depression is utilized to obtain the change in incremental distance. Furthermore, the incremental distance is made proportional to the needle spacing and not directly equal thereto. A means for converting the incremental change in thickness of the actual needle spacing is provided by a unique shogging lever operatively coupled to the slider bar associated with the guide apparatus.

SUMMARY OF THE INVENTION

Therefore it is an object of the present invention to provide a guide setting arrangement wherein the adjustable setting elements are of sufficient thickness and stability to provide reliable incremental units of displacement for the guidebar.

It is another object of the present invention to provide a simple long wearing mechanism that may be operated at relatively high speeds.

It is a further object of the present invention to provide a shogging guide apparatus which utilizes setting elements that are thicker in the longitudinal direction than the space between the needles on the needle bar with the incremental units of displacement being obtained by a reduction in the thickness of the setting element.

It is a further object of the present invention to provide a guide means which contains a plurality of setting elements with one setting element remaining stationery and being thicker than a pair of elements disposed on either side thereof; the pair of setting elements being provided with a step portion different in thickness from each other and from the stationery element to provide incremental units of displacement which may be used to shog a guidebar.

The guidebar shogging guidebar apparatus, according to the principles of the present invention, for warp knitting machines having a guidebar, a needle bar with a plurality of equally spaced needles disposed thereon and a power driving source operatively coupled thereto, the shogging guide apparatus shogging said guidebar in predetermined increments parallel to the needle bar, comprises in combination, at least one elongated slider bar means operatively coupled to the guidebar for moving the guidebar in a direction parallel to the needle bar and guide means operatively coupled to the slider bar means for providing incremental longitudinal displacements for the slider bar means according to a predetermined program. The guide means includes a housing positioned to cooperate with and guide the slider bar means along its longitudinal axis and a plurality of setting elements is disposed within the housing and transversely movable between a first position and a second position. The number of elements disposed in the first position are directly proportional to the displacement of the slider bar. The position of the setting elements are determined by a predetermined program. One of the setting elements is positioned to remain stationery in the first position and is positioned between a pair of setting elements. The pair of setting elements have a step portion the thickness of which, in the longitudinal direction, is different from each other and from the remaining elements. The stationery setting element is thicker in the longitudinal direction than the step portion of the pair of setting elements preventing contact between the pair of setting elements when the step portions of the setting elements are juxtaposed with the stationery element therebetween. Also included is a programming means operatively coupled to all the movable setting elements for selectively positioning the setting elements in the first or the second position in accordance with the predetermined program.

The foregoing and other objects and advantages will appear from the description to follow. In the description reference is made to the accompanying drawing which forms a part hereof, and in which is shown by way of illustration a specific embodiment in which the invention may be practiced. This embodiment will be described in sufficient detail to enable those skilled in the art to practice the invention and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawing in which.

DESCRIPTION OF THE PREFERRED EMBODIMENT

Figure 1:
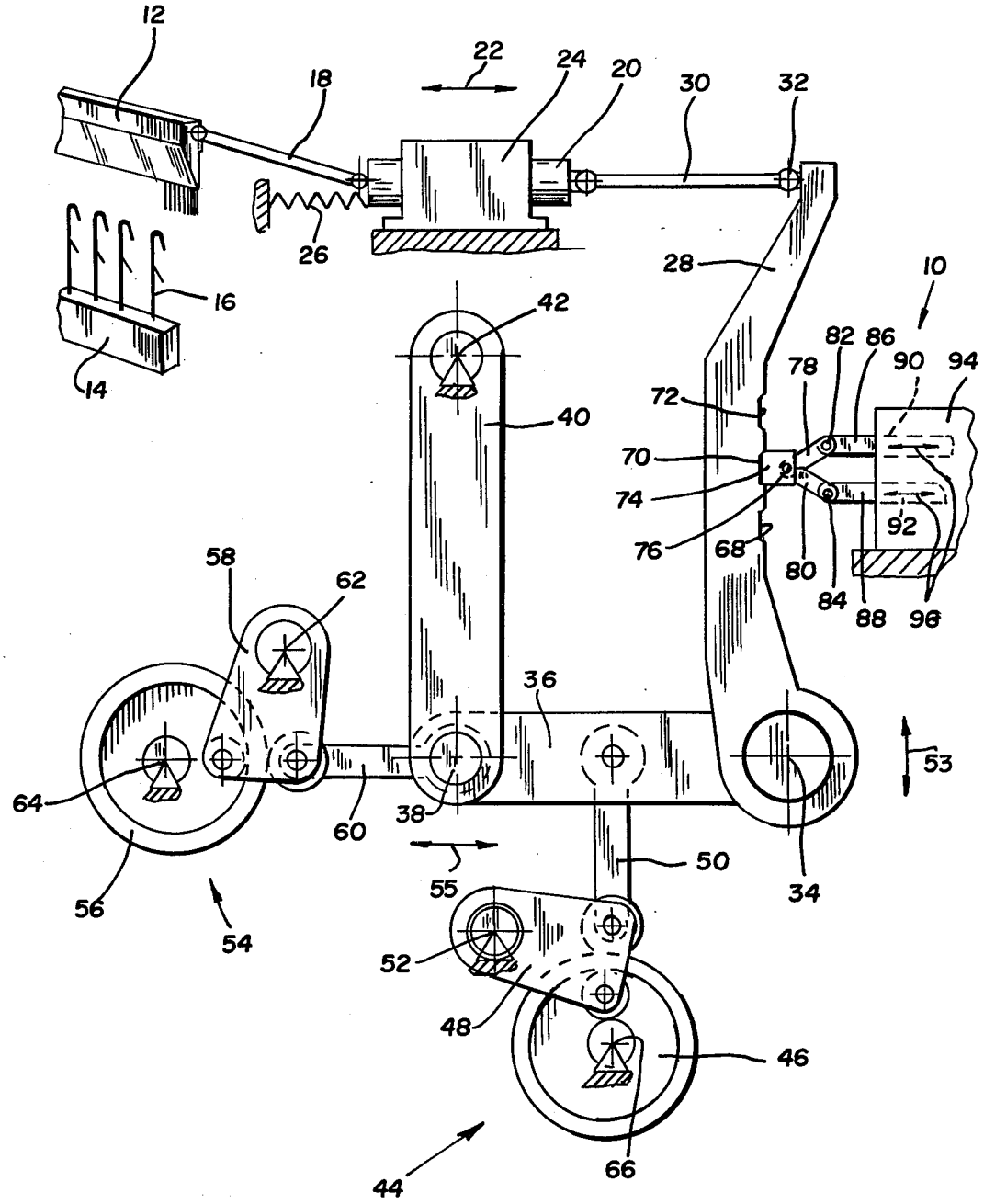
FIG. 1 is a schematic side view of the linkages coupling the guide apparatus to the guidebar, according to the principles of the present invention.

Referring now to the figures, and in particular to FIG. 1, which is a partial schematic side view of a warp knitting machine having a guidebar shogging guide apparatus 10 operatively coupled to a guidebar 12 that is caused to be displaced in fixed incremental units in accordance with a predetermined program. The guidebar 12 is of conventional design and is similar to that disclosed in the text entitled: "Warp Knitting Technology" by D. F. Paling and is incorporated herein in its entirety. The warp knitting machine, not shown, includes a needle bar 14 which has a plurality of needles 16 affixed therein in a conventional manner. The pattern drive or guidebar shogging guide apparatus 10 controls the displacement of the guidebar 12 relative to the needles 16. Guidebar 12 is connected, via a steering rod 18, which is flexibly coupled to a shaft 20 that moves back and forth in a lateral or transverse direction, as shown by arrow 22, in a fixed housing 24. This arrangement is biased to a zero or set position by a return spring 26. The shaft 20 is connected to shogging lever 28, via a connecting rod 30 acting upon a ball joint 32 which is rotatable about a pivot axis or shaft 34. Pivot axis 34 is connected, via a connecting rod 36, to pivot point 38 which is disposed at the opposite end thereof. Pivot point 38 has support lever 40 affixed thereto. Support lever 40 is pivotable about axis 42 at its opposite end.

An alternating drive means 44 that includes an eccentric cam disc 46 and a guide lever 48 coupled thereto is also coupled, via pushrod 50, to connecting rod 36. The far end of guide lever 48 is pivotally connected to pivot point 52 thereby providing motion to the pivot axis 34 in the direction of arrow 53. The alternating drive means is coupled, in a conventional manner to the power driving source, not shown.

A compensating drive means 54 that includes an eccentric cam 56 coupled thereto and a guide lever 58 is similarly coupled to connecting rod 36, via a pushrod 60. The far end of guide lever 58 is pivotable around an axis 62. Eccentric cam 56 rotates about axis 64 and eccentric cam 46 rotates about axis 66. The compensating drive means 54 is also coupled to the power driving source, in a conventional manner, not shown.

The shogging lever 28 is provided with a plurality of notches 68, 70 and 72 which are adapted to receive keying element 74 therein. Keying element 74 is preferably in the form of a small block and rests within the notches 68, 70 or 72. Keying element 74 is provided with a pivot axis 76 which has one end of rods 78 and 80 pivotable thereabout. The other end of rods 78 and 80 are provided with pivoting axis 82 and 84, respectively which has coupled therein slider bars 86 and 88, respectively, which extend into channels 90 and 92 provided in the housing 94 of the guidebar shogging guide apparatus 10. Slider bars 86 and 88 are provided with a direction of motion indicated by arrows 96. Pivot point 76 lies on a straight line connecting the central point of pivot axis 34 and is central point of ball joint 32.

Figure 2:
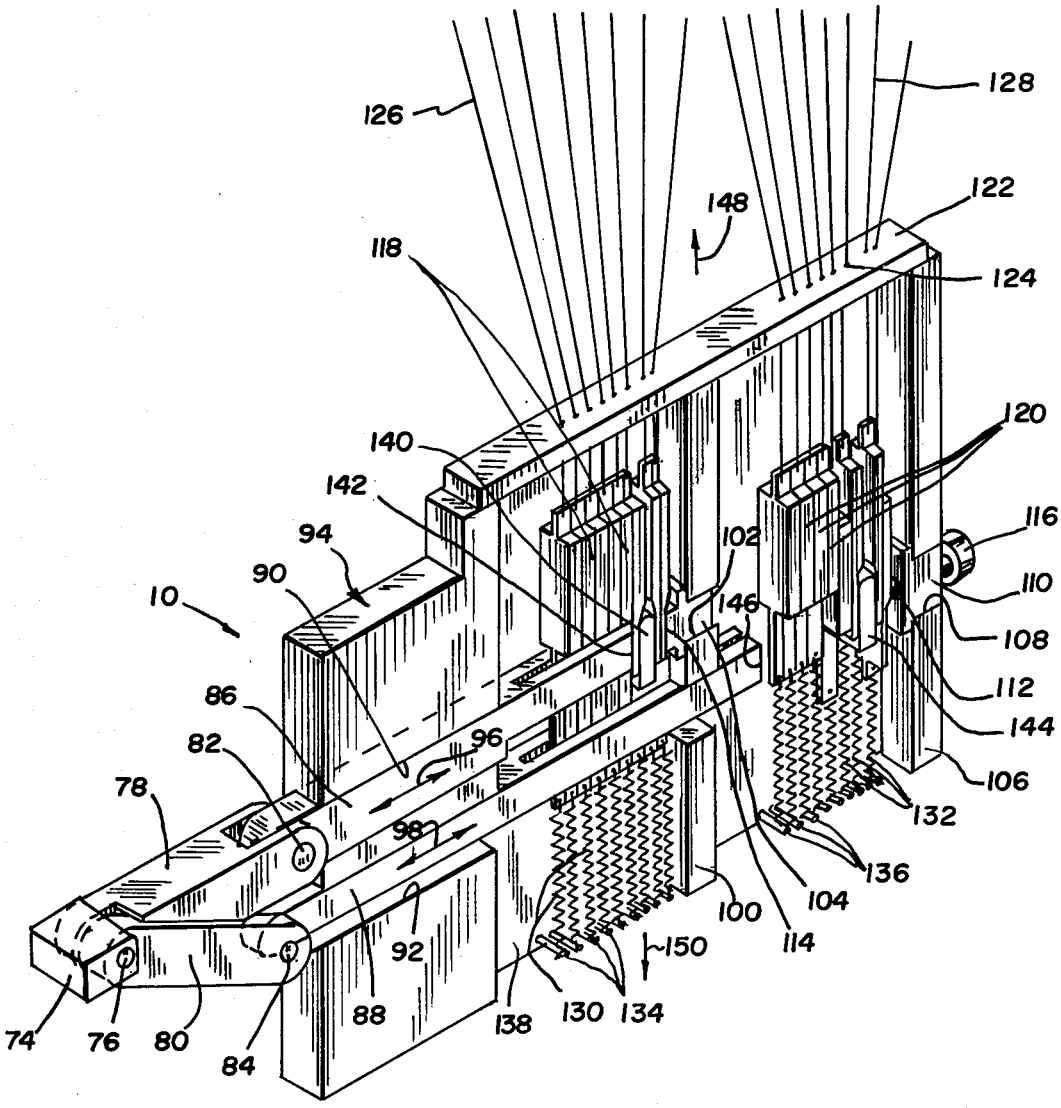
FIG. 2 is a perspective view of a pair of guide apparatuses utilized with two slider bars of the present invention.

The shogging guide apparatus is illustrated in more detail in FIG. 2 and is shown to include two channels 90 and 92 which slidable receive slider bars 86 and 88 respectively therein, for movement in a longitudinal direction as indicated by arrows 96 and 98.

The housing 94 preferably includes a first vertically transverse wall 100 which is provided with an opening 102 that is adapted to receive stop block 104 that functions as a striker plate or impact surface for the slider bar 86. A second transverse wall 106 is provided at the rear of housing 94 and includ an opening 108 adapted to receive stop block 110 therein. Stop block 110 includes flat surface 112, which functions as a fixed stop or impact surface for slider bar 88, as will be explained hereinafter. Stop block 110 functions in the same manner as stop block 104 and its associated impact surface 114. The stop block 110 further includes an adjustment screw 116 which may be used to position the impact surface 112 and align its position with respect to slider 88 so that it is in the same position as impact surface 114 with respect to slider 86, thereby positioning keying element 74 in the exact same position for the corresponding identical positions of the setting elements 118, that cooperate with slider bar 86, with the setting elements 120 that cooperate with slider bar 88.

The top or cover 122 of housing 94 is provided with a plurality of apertures 124 to permit the passage therethrough of a plurality of harness strings 126 and 128 from a conventional jacquard mechanism, not shown. Harness strings 126 are connected to setting elements 118 and are utilized to move the setting elements out of their normal rest position which is accomplished by the use of return springs 130. Harness strings 128 are affixed to setting elements 120, in a conventional manner, and are utilized to position setting elements 120 out of their rest position which is maintained by the use of return springs 132 affixed to the opposite ends of the setting elements 120 in exactly the same manner as springs 130 are affixed to the opposite ends of setting elements 118. The springs 130 and 132 are preferably maintained in position by having their far ends affixed to pegs 134 and 136, respectively, fixed to a vertical longitudinal rear wall 138. Intermediate or stationery setting element 140 is adapted to cooperate with slider bar 86 and is provided with its own return spring 134 but is not provided with a harness string coupled to the jacquard mechanism so that it is always maintained in a fixed position in line with the impact surface and the end 142 of slider bar 86. A similar stationery element 144 is provided in line with impact surface 112, is maintained in position by its own return spring 132 and is kept in line with the end 146 of slider bar 88. Stationery element 144 is not provided with a harness string since it is always maintained in the same position.

As disclosed, the guidebar shogging guide apparatus appearing in the housing 94 is repeated twice permitting the utilization of either slider bar 86 or slider bar 88. Thus, since slider bar 86 alternates with slider bar 88 to position key element 74 it permits the resetting of one group of shogging guide setting elements 118 while the other group of shogging guide setting elements 120 is being utilized to control the position of the slider bar, thereby permitting the warp knitting machine to operate at much faster speeds, since no time is lost in waiting for the resetting of the shogging guide elements.

Each of the setting elements 118 is provided with its own harness string 126 and its own return spring 130, except the stationery setting element 140, so that any program set in the jacquard mechanism which activates harness strings 126 can, in accordance with the predetermined program set into the jacquard mechanism, adjust the incremental spacing for deflection of the guidebar by positioning the setting elements 118 from its normal rest or return position to its activated position which would remove them from coming into the impact path of the slider bar, stationery element 140, and impact surface 114. The same operation would follow for slider bar 88 and setting elements 120 utilized with stationery element 144 at contact surface 112.

Figure 3:
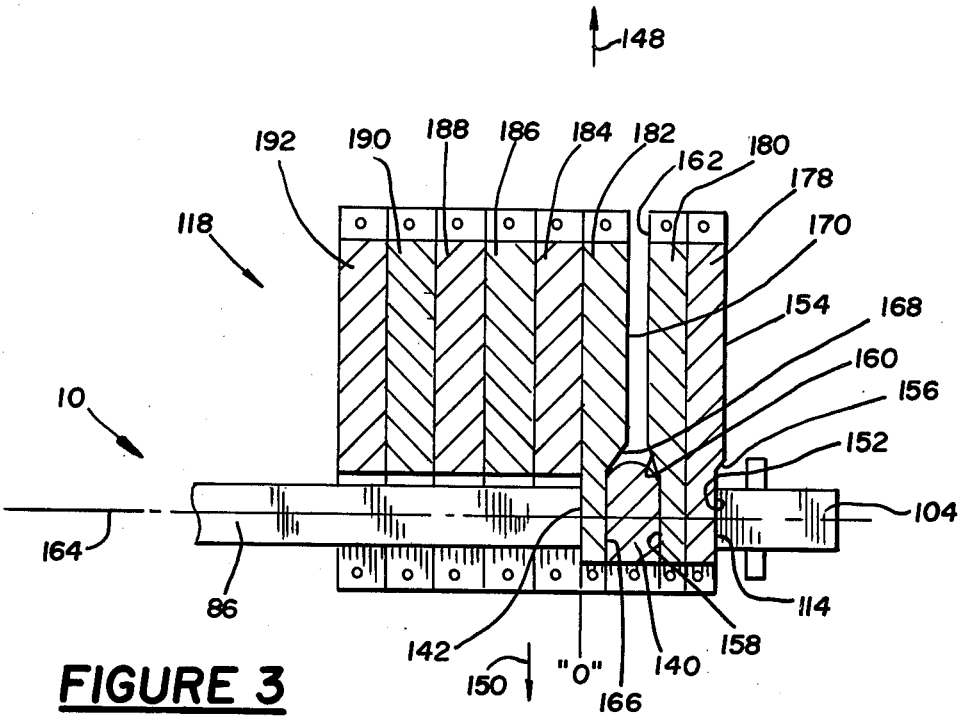
FIG. 3 is a side view in elevation of the setting elements shown in FIG. 2 in a zero or reference setting.
Figure 4:
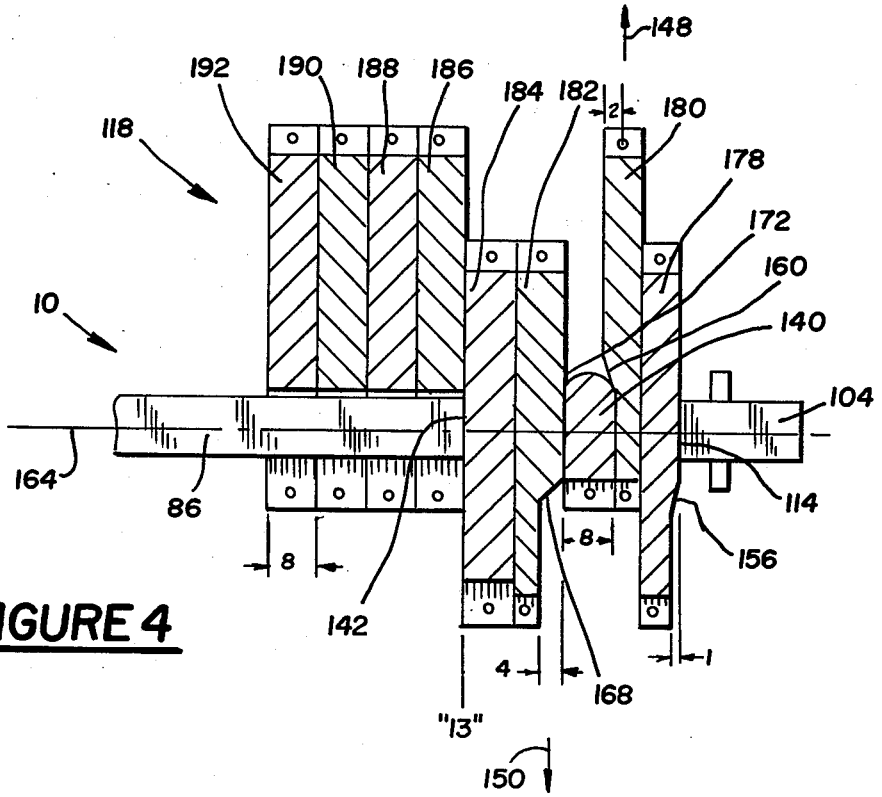
FIG. 4 is a side view in elevation of a setting element of FIG. 2 in a position which yields 13 units of longitudinal displacement of the slider bar.

Referring now to FIGS. 3 and 4 which is an enlarged view of the setting elements 118, slider bar 86, stop block 104 and stationery element 140. The associated harness strings and return springs affixed to the ends of the elements 118 have been deleted for clarity. FIG. 3 discloses the position of each element 178, 180, 182, 184, 186, 188, 190, and 192 as they would appear in their zero or reference position. The amount of transverse movement of guidebar 12 is determined by the amount of displacement given to the slider bar 86 with respect to the zero or reference position. The zero or reference position is determined by the portion of the setting elements that appear in line in the longitudinal direction of the slider bar 86 with the change in distance appearing between the end 142 of slider bar 86 and the impact surface 114 provided on stop block 104. In the present embodiment of the invention, the longitudinal thickness of the setting elements determines the amount of incremental displacement units the guidebar 12 will be displaced. It is to be understood that although the shogging guide apparatus 10 is shown singularly that two guide apparatuses are included in the housing 94 for optimum performance.

As can readily be determined from FIGS. 3 and 4 a complete set of setting elements 118 includes eight movable elements and one stationery element 140. Elements 178, 180 and 182 are greater in length than the remaining elements and always extend into the travel path of slider element 86. Setting element 178 is preferably chosen to be of sufficient thickness to be reliable, sustain indefinite wear and be able to receive the impact of slider element 86 as it advances toward stop block 104. The setting elements are moved in the direction of arrow 148 when the strings 126 are activated on the jacquard mechanism and returned or reset in the direction of arrow 150 by the return springs 138. The jacquard strings and springs have been eliminated from FIGS. 3 and 4 for the purposes of clarity. The side of element 178 facing stop block 104 is provided with a stepped portion 152 which is parallel to the surface 154 and is provided with a sloped rise 156. The depth of step 152 below the surface 154 is made to be equal to one unit of displacement. Setting element 180 is similarly provided with a stepped portion 158 and a sloped rise 160. The stepped portion surface 158 is parallel to the surface 162 on element 180 and is two units of displacement thinner in the longitudinal direction along the axis 164 of slider bar 86. Setting element 182 is provided with a stepped portion 166 having a rise 168. The surface 170 is parallel to the surface 166 and surface 166 is preferably four units of displacement less than the overall thickness in the longitudinal direction of setting element 182. The thickness of stationery setting element 140 in the longitudinal direction is eight units. Setting elements 178, 180, 140 and 182 are in their activated position and provide the zero reference. Also note that the surface 162 on setting element 180 is not in contact with the surface 170 on setting element 182 since the depth of the steps provided in the setting element pair are unequal and the sum thereof (four plus two) is less than the number of units of thickness (eight) of setting element 140.

Referring now to FIG. 4 wherein setting elements 178, 182, and 184 have been released by the program set into the jacquard mechanism so that they may return to their normal or rest position as urged by their respective return springs. If we consider the change in distance from the end 142 of slider bar 86 to the impact surface 114 on stop block 104, we can see the number of deflection units that the guidebar 12 will be subjected to. The incremental step or increase in thickness in the longitudinal direction contributed by setting element 178 moving downwardly in direction of arrow 115, is one unit. The increase in thickness contributed by setting element 182 moving in the downwardly direction is four units and the increase in thickness in the longitudinal direction contributing by setting element 184 moving in the downwardly direction is eight units. The total incremental thickness has changed from a reference of zero to thirteen units of displacement. Thus, the movement of slider bar 86 is limited in its travel by thirteen units of displacement thereby causing keying element 74 to move shogging lever 28 which in turn moves connecting rod 30, shaft 20, steering rod 18 and guidebar 12 in a transverse direction parallel to the needle bar thirteen needles. It is obvious then that any number of deflections may be obtained by the combinations of setting elements being moved into position so that the slider bar may be prohibited from moving all the way to the zero or reference position.

A second guidebar shogging guide apparatus is included in the housing 94 and is controlled by the harness strings 128 in accordance with a predetermined program of the jacquard mechanism, not shown, as explained earlier. With the configuration as disclosed in FIG. 3, any displacement between zero and forty-seven units may be provided.

During operation, the eccentric drive 44 moves lever 28 out of the position indicated in FIG. 1 in an upwardly direction into the position indicated in FIG. 2. Lever 78 is stretched out so that the rearward end 142 of the first slider bar 86 comes into contact with the first of the dropped setting elements. This setting element in turn is pushed against any other of the dropped setting elements and into the impact surface 114 of stop block 104. In this manner, keying element 74 moves shogging lever 28 the programmed unit of the deflection which is transferred to the guidebar 12. At the same time the angle of the lever 80 is so altered that the slider 88 is pulled forwardly (to the left as shown by arrow 96). The rearward end 146 of slider bar 88 is thus out of contact with the setting elements 120. These may now be readily displaceable by the release of the proper harness strings by the jacquard mechanism so that the next predetermined unit of displacement may be set. If at this point in time the shogging lever 28 is lowered, lever 80 is brought into the extended position, thus the rearward end 146 of slider bar 88 contacts the forwardmost of the dropped setting element. There is thus provided another new position for the guidebar. At the same time the slider bar 86 is pulled forwardly (to the left in the direction of arrow 96) so that the setting of elements cooperating therewith can be reset with minimal effort. This arrangement provides for the movement of the guidebar in the direction of arrow 22 (laterally).

In the upward and downward movement of the shogging lever 28 the keying element 74 and therewith guidebar 12 undergo a small backwards and forwards displacement in the direction of arrow 96 and possibly in the direction of arrow 22 by reason of the swinging movement of levers 78 and 80 and also when the setting elements 118 and 120 do not cause any displacement of the guidebar. The superimposed movements which are undesirable in a high speed knitting machine can be reduced by the resistance of a compensating drive arrangement 54 which moves the swinging axis 34 in a similar path to the translation movement of keying element 74 so that this movement is in fact not transferred to the ball joint 32. The shogging guide is suitable for different needle separation. The keying element 74 need only be moved to another slot 68 or 72 provided on shogging lever 28 to acquire the required displacement. Thus, the present embodiment provides different displacement relationships for the shogging lever 28 and the guidebar may be correspondingly moved a different distance laterally (transverse direction) which is proportional to the number of displacement units selected.

Utilizing a stationery setting element as disclosed herein with a pair of elements disposed on either side thereof it is possible to hold the setting elements in the desired separation without maintaining the active portion of the setting element in a continuous force-contacting relationship. Thus, by providing on both sides of the stationery intermediate element, setting elements having a step facing each other and directed towards the intermediate element and with the thickness of the intermediate element being greater than the sum of the thickness of the steps it is possible to reduce the amount of frictional contact between the setting elements and only one intermediate element may be used for two setting elements. Stationary setting element 140 and 144 is provided with a curved edge portion 172 to facilitate the movement of the slider elements 180 and 182 as each moves in and out of position. With the shogging guide apparatus of the instant invention it is possible to utilize a single unit to control the shogging distance with various needle spacings so that the same pattern or guide may be utilized for different needle separation if the design is to be the same.

Hereinbefore has been disclosed a reliable, simple guidebar shogging guide apparatus that is rugged and can sustain constant use. The configuration is adaptable for use with units of varying needle spacings on the needle bar with a minimum amount of adjustment to the apparatus. It will be understood that various changes in the details, materials, arrangement of parts and operating conditions which have been herein described and illustrated in order to explain the nature of the invention may be made by those skilled in the art within the principles and scope of the present invention.

Having thus set forth the nature of the invention, what is claimed is:

1. A guidebar shogging guide apparatus for warp knitting machines having a guidebar, a needle bar with a plurality of equally spaced needles disposed thereon and a power driving source operatively coupled thereto, said shogging guide apparatus shogging said guidebar in predetermined increments parallel to said needle bar, comprising in combination:

(a) at least one elongated slider bar means operatively coupled to said guidebar for moving said guidebar in a direction parallel to said needle bar;

(b) guide means operatively coupled to said slider bar means for providing incremental longitudinal displacements for said slider bar means according to a predetermined program, said guide means including;

(i) a housing positioned to cooperate with and guide said slider bar means along its longitudinal axis, and (ii) a plurality of setting elements disposed within said housing and transversely movable between a first position and a second position, the the number of elements being disposed in said first position being directly proportional to the displacement of said slider bar, the position of said setting elements being determined by a predetermined program, one of said setting elements being positioned to remain stationary in said first position, said stationary setting element being positioned between a pair of setting elements, said pair of setting elements having a stepped portion, the thickness of the stepped portion of said pair of setting elements in the longitudinal direction being different from each other and from the remaining elements, said stationary setting element being thicker in the longitudinal direction than the stepped portion of said pair of setting elements preventing contact between said pair of setting elements when said stepped portions are juxtaposed with said stationary element therebetween; and (c) programming means operatively coupled to all said movable setting elements for selectively positioning said setting elements in said first or said second position in accordance with said predetermined program.

2. The shogging guide apparatus according to claim 1 wherein said slider bar means further includes a shogging lever, said shogging lever being operatively coupled between said guidebar and said slider bar means, said shogging lever being provided with adjusting means for selectively connecting said incremental longitudinal displacements to be proportional to the distance between the needles on said needle bar.

3. The shogging guide apparatus according to claim 1 wherein the longitudinal thickness of said stationary setting element exceeds the sum of the longitudinal thicknesses of the stepped portions of said pair of setting elements.

4. The shogging apparatus according to claims 1 or 2 wherein said pair of setting elements and an additional setting element each have a stepped portion with a longitudinal thickness different from each other and have a longitudinal thickness in the stepped portion which is different from the remaining setting elements.

5. The shogging guide apparatus according to claim 4 wherein the stepped portion of said additional setting element is in intimate contact with a reference stop means in said first position and the stepped portions of said pair of setting elements are juxtaposed with said stationary setting element disposed therebetween in said first position to provide a zero or reference displacement for said guidebar.

6. The shogging guide apparatus according to claim 1 wherein said stepped portions are formed which have an angled rise therebetween.

7. The shogging guide apparatus according to claims 1 or 6 wherein the edge of said stationary element pair proximate the stepped portions of said setting element is formed with a curved edge.

* * * * *